US005171291A

United States Patent [19]

d'Alayer de Costemore d'Arc et al.5]

[11] Patent Number: 5,171,291

Date of Patent: Dec. 15, 1992

[54] ELECTRICAL PLUG REMOVING MECHANISM

[75] Inventors: Stephane M. d'Alayer de Costemore d'Arc, Brussels; Michel C. G. Mortier, Ans, both of Belgium

[73] Assignee: Staar S.A., Belgium

[21] Appl. No.: 744,510

[22] Filed: Aug. 14, 1991

[30] Foreign Application Priority Data

Aug. 16, 1990 [BE] Belgium ..... 9000790

[51] Int. Cl.5 ..... H01R 13/00

[52] U.S. Cl. ..... 439/152

[58] Field of Search ..... 439/152-160

[56] References Cited

U.S. PATENT DOCUMENTS

| | | | |
|---|---|---|---|
| 2,161,353 | 6/1939 | Hummel | 439/160 |
| 2,551,382 | 5/1951 | Lindsay | 439/159 |
| 4,045,106 | 8/1977 | Borg | 439/152 |

*Primary Examiner*—Joseph H. McGlynn
*Attorney, Agent, or Firm*—Leydig, Voit & Mayer

[57] ABSTRACT

A removing mechanism for a plug assembly which is inserted in an retracted from a socket upon axial movement of the plug assembly, the mechanism having relatively movable concentric members arranged around either a plug assembly or a socket, one of the members being an actuating member, a retainer which holds the actuating member to the plug assembly or the socket and allows relative rotational movement, and one of the members transmitting axial movement to cause axial movement of the plug assembly to retract the plug from the socket; and a motion converting connection between the members including an angled cam on the actuating member and cooperating surface on the other member which converts a manual force applied to rotate the actuating member relative to the other member into an axial force pressing against the socket and an equal and opposite axial force applied to the plug assembly which moves the plug assembly axially in a direction away from the socket and retracts the plug assembly.

25 Claims, 13 Drawing Sheets

ELECTRICAL PLUG REMOVING MECHANISM

The present invention relates to mechanisms for removing plugs from sockets and, more particularly, for removing electrical plugs more easily from electrical sockets in which they have been positioned.

As herein disclosed, a socket refers to an element which generally comprises the "female" portion of a connector. A plug or plug assembly refers to an element which generally comprises the "male" portion of a connector. In typical household applications, an electrical socket includes permanently powered contact clips which are fixed to a wall, and the plug includes axially extending conducting pins which are electrically connected to an appliance and inserted into the socket to power the appliance. The plugs described herein are not limited to electrical connectors, and may comprise plugs and sockets of any type including electronic or other connectors in either a male or female configuration.

It is well known that ordinary electrical plugs, although easy to insert into a standard socket, are by contrast difficult to remove from such a socket. The only method currently available to the user is to grasp a plug by its end which is generally fastened to an electric cable and pull it from the socket. The gripping surface of the plug is relatively limited, and the plug provides little support to enable a user to apply a force sufficient to remove the plug from the socket.

The contact clips or lugs within the socket comprise spring clips which are designed to tightly enclose the pins of a plug when inserted. The size of the opening in each spring clip remains constant in order to provide a clean electrical contact for varying pin sizes. However, the diameter or width of the pins increases in proportion with the current that the plug is capable of carrying. This increases the surfaces of contact between the lugs or clips and the pins in order to avoid any overheating. Thus, the removing of plugs becomes more and more difficult in plugs rated to carry larger currents.

Plugs which can accommodate currents of 4 to 10 amperes are commonly used for domestic appliances such as vacuum cleaners, deep fryers, food processors, etc. When the user wishes to pull out such a plug, the user tends to exert the maximum force on the plug without holding back the socket. Often, repeated use results in either the socket being wrenched from its support or the electrical cable being wrenched from the plug. This not only results in damage to the socket and plug, but also increases the risk of electrocution when using the damaged devices.

For both young and old individuals, the removing of even a low amperage plug can be a difficult undertaking. In addition to the physical strength requirements, there is always the danger of the user's fingers contacting the metal plug ends while the plug is still powered by the socket.

SUMMARY OF THE INVENTION

Considering the widespread use of ordinary plugs of the type described above, the principal object of the invention is to provide a simple and effective mechanism enabling the completely safe removing, with minimum effort, of an electrical plug from the socket in which it has been positioned without any damage to either the socket or to the plug and the cable which is attached.

A related object is to eliminate risk of electrocution by any user who might wrench the socket or the electrical cable while attempting to remove a plug.

The present invention achieves the above mentioned objects and overcomes the aforesaid problems by providing simple, reliable, and economical removing mechanisms for electrical plugs and plug assemblies which eliminate the possibility of damaging either the plug or socket while removing a plug from the socket in which a plug assembly has been positioned. According to the invention, removing mechanisms are provided which permit the removing of an electrical plug assembly from a socket and are so ergonomically designed that the user is not tempted to grasp the electrical cable.

Removing mechanisms constructed according to the invention are mounted either on electrical plug assemblies or on electrical socket assemblies, and require no fundamental and costly modifications. The plug or socket assembly and removing mechanism in a common housing can easily replace existing plugs or sockets, and use standard components which have already been approved by the various safety and/or standards organizations—avoiding unnecessary administrative approval procedures.

The removing mechanism of this invention reduces the force required to remove any plug by a ratio of approximately 1:3. No pulling force is exerted either on the cable or on the socket, and thus plugs can be removed safely and effortlessly. The tearing force normally associated with the removing of plugs is exactly and fully counterbalanced by a pressure force exerted by a reaction member on the socket assembly. This ensures that neither the socket nor the wire can be damaged. The removing mechanisms can be adapted to any kind of plug or socket available on the market—including those in which the cable exits the plug in a lateral, or in an axial, direction. The removing mechanisms can be easily used and operated when plugs are inserted side by side on multi-socket. In addition, the removing mechanisms can be applied to any approved plug which supports the main supply pins, or to any approved socket which includes the main supply contact clips.

DESCRIPTION OF THE PREFERRED EMBODIMENTS

Figure 1:
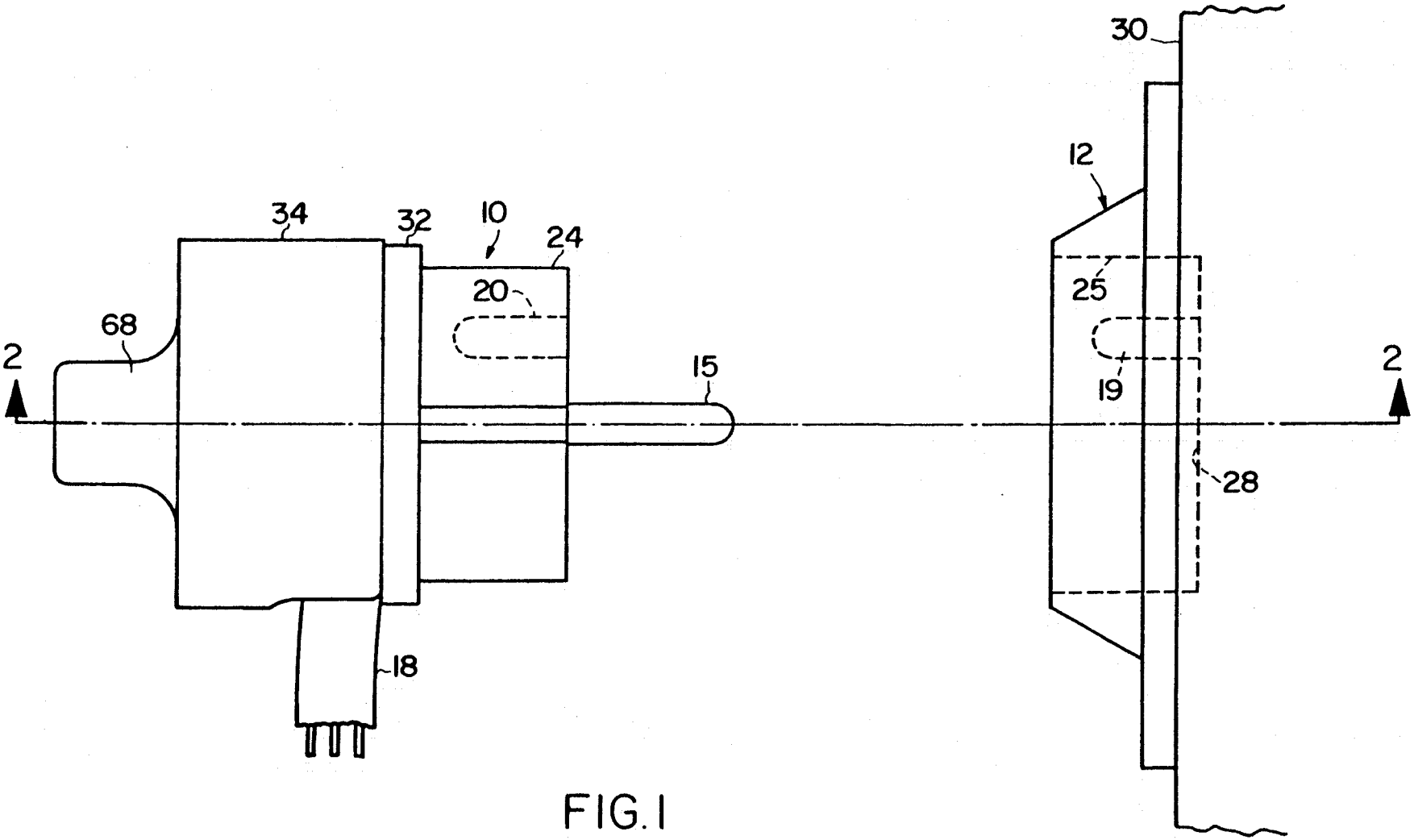
FIG. 1 is a side view of an electrical plug assembly shown separated from a standard electrical socket, the electrical plug assembly having a removing mechanism according to a first embodiment of the invention.
Figure 2:
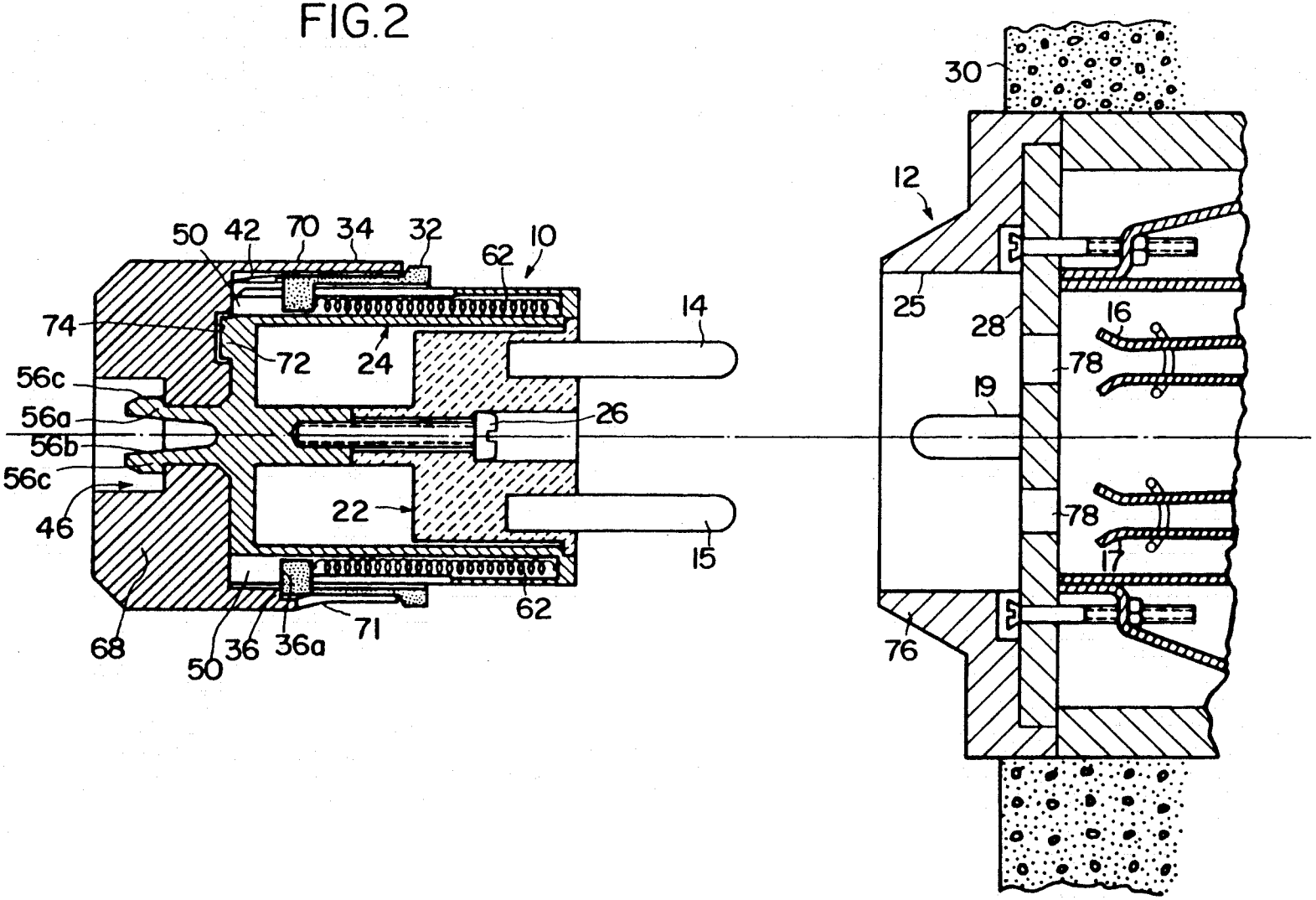
FIG. 2 is a horizontal cross-sectional view of the separated plug assembly and socket shown in FIG. 1 taken in a horizontal plane, perpendicular to the drawing plane, and viewed from the bottom.

Referring to FIG. 1, a plug assembly 10 incorporating a removing mechanism according to the invention is shown separated from a standard socket 12 in which the plug assembly 10 may be inserted by a user. In FIG. 2, the same separated plug assembly 10 and socket 12 are shown in horizontal cross-section viewed from the bottom. Now referring to FIG. 3, the same plug assembly 10 and socket 12 in horizontal cross-section viewed from the bottom (as in FIG. 2) are shown together, with the plug assembly 10 inserted in the socket 12 and conductor pins 14, 15, which extend from the plug assembly 10, received in contact clips 16, 17 of the socket 12. The contact clips 16, 17 are energized from the electrical supply mains and supply power through the plug pins 14, 15 to an appliance connected by a cable 18 to the plug assembly 10. The socket 12 also preferably has a "ground" pin 19 which is received in a "ground" contact clip 20 of the plug assembly 10 when the plug assembly 10 is inserted axially into the socket 12 by the user.

Figure 9:
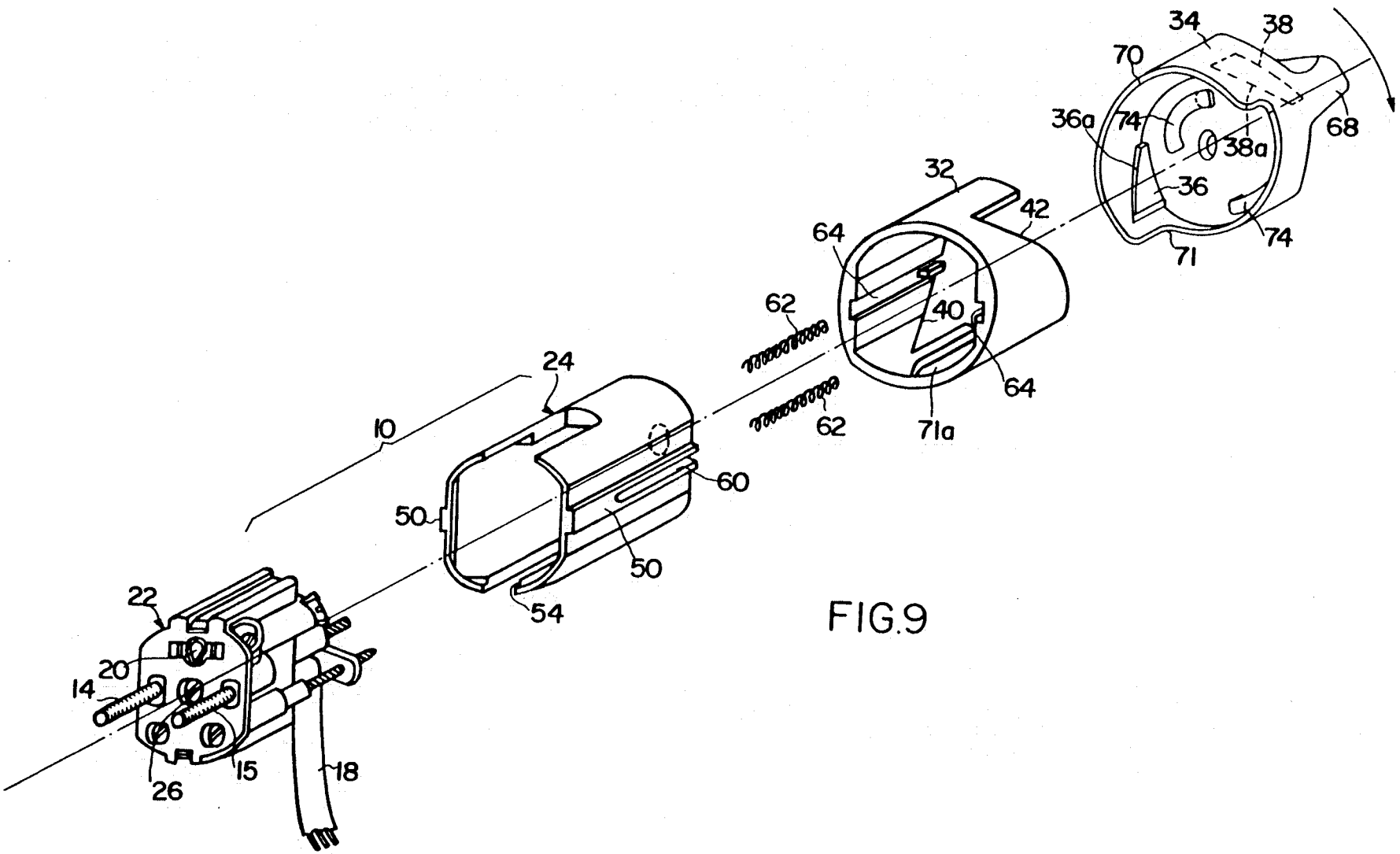
FIG. 9 is an exploded view of a plug assembly and removing mechanism according to the first embodiment of the invention as illustrated in FIGS. 1–4.
Figure 10:
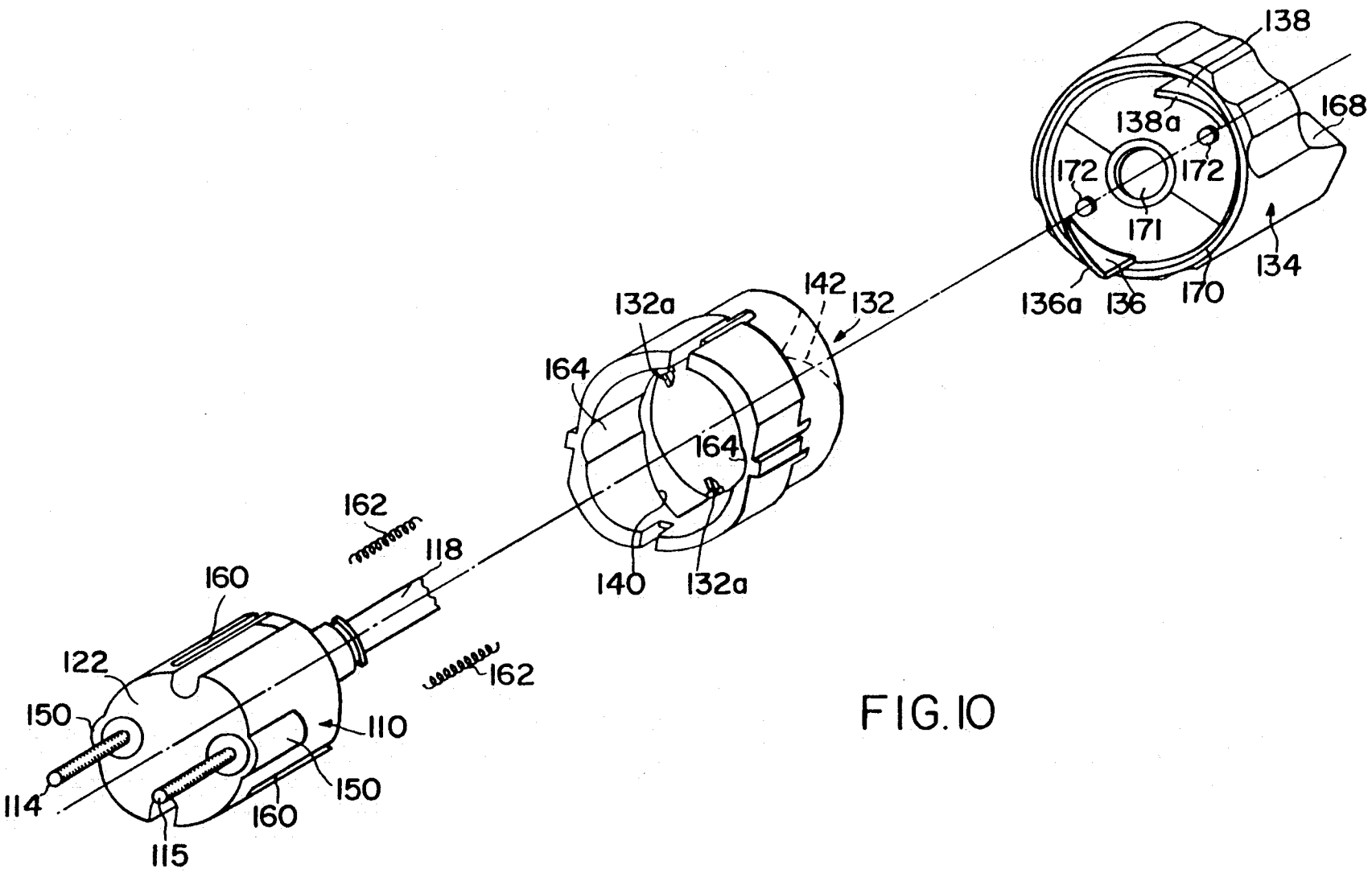
FIG. 10 is an exploded view illustrating a plug assembly and removing mechanism according to the alternative embodiment of the invention illustrated in FIGS. 5–7.

Turning now to FIG. 9 which is an exploded view of the plug assembly 10 and removing mechanism embodiment shown in FIGS. 1–4, in this embodiment the plug assembly 10 will be seen to include a support 22 for the conductor pins 14, 15, which is typically a molded plastic component that supports the conductor pins 14, 15, and a cylindrical body 24 which is fixed to the support 22. The conductor pins 14, 15 are conductive metal parts as is the "ground" contact clip 20. The support 22 is assembled within the cylindrical body 24 and is fastened to the body 24 by means such as a screw 26. The outer profile of the assembled support 22 and body 24 as viewed from the front end (the end carrying the pins 14, 15) is normally specified by electrical codes, the illustrated assembly meeting current standards of certain European countries. Likewise, the socket 12 has a recess 25 as illustrated in FIGS. 1–4 which meets such standards for sockets. It will be understood that the plug and removing mechanism of this invention, however, can be readily modified and adapted to meet standards and codes of other countries.

Referring again to FIG. 3, it will be seen that when the plug assembly 10 is fully inserted into the socket 12, the pin support 22 and body 24 are seated against the bottom surface 28 of the socket 12, and the pins 14, 15 are received in and engaged by the powered contact clips 16, 17. These contact clips 16, 17 tightly grip the pins 14, 15 which makes it difficult for the user to remove the plug assembly 10 from the socket 12 by pulling it from the socket. It will also be seen that any force applied by the user simply to pull the plug assembly 10 from the socket 12 will exert a force pulling the socket 12 from the wall 30 to which it is fastened. This force must be resisted by the anchoring devices (screws or other fasteners) which are utilized for holding the socket 12 to the wall 30, and such force may loosen these devices or damage the socket 12 or the plug assembly 10, increasing the risk of electrocution when damaged devices are used, or when the metal elements of the plug are contacted by a user's fingers when trying to remove the plug under a condition where the plug is still powered by the socket.

Figure 3:
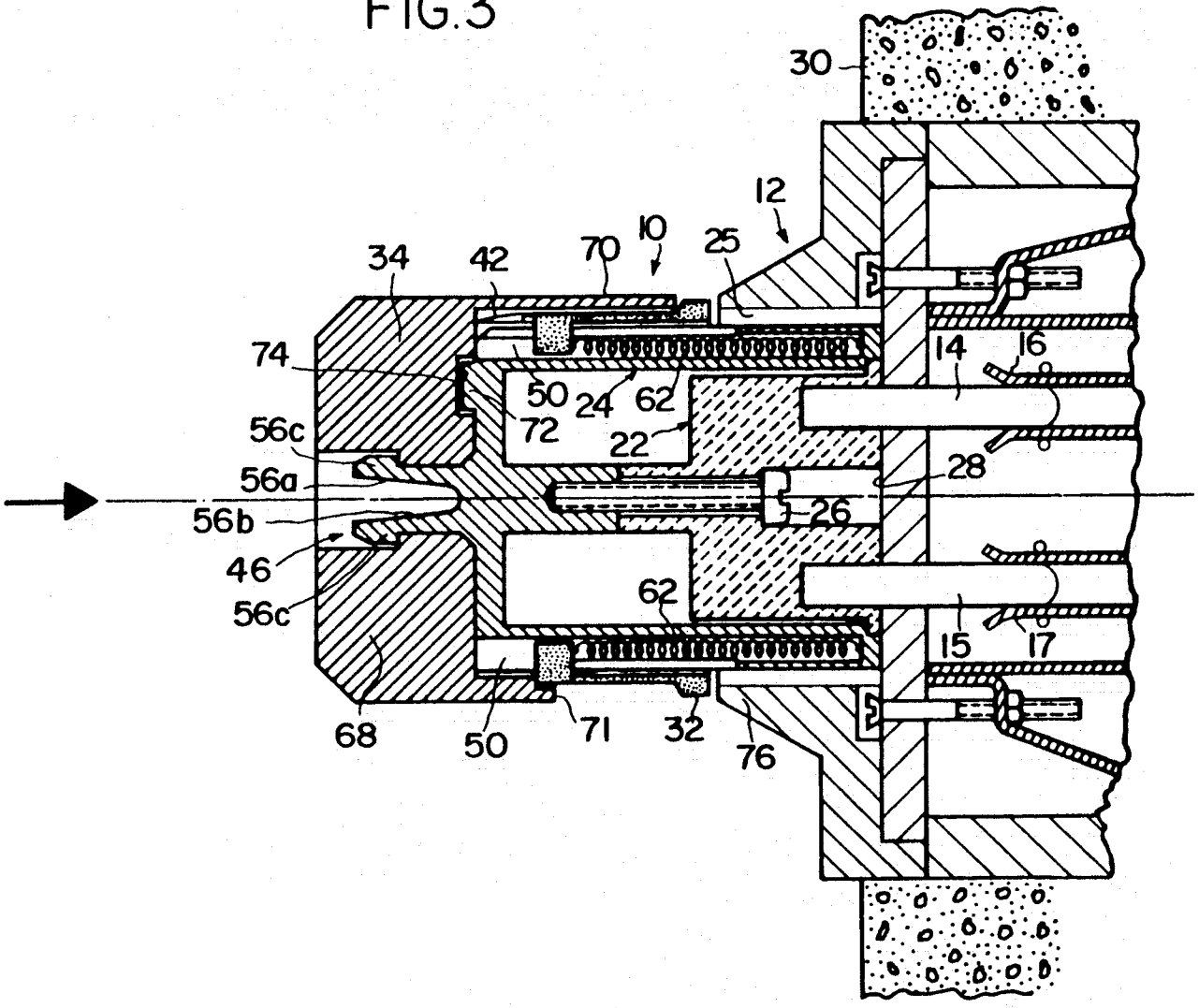
FIG. 3 is a horizontal cross-sectional view of the plug assembly and socket of FIGS. 1 and 2 with the plug assembly inserted in the socket.

According to the present invention, in order to apply a force to remove the plug assembly 10 which is not simply transmitted from the user to pull the plug assembly 10 from a socket in which it is located, a removing mechanism is provided including a control mechanism mounted on the plug assembly 10 for moving the plug assembly 10 axially to retract the pins 14, 15 when inserted in a socket. In carrying out this invention, the control mechanism includes concentric relatively movable members including a tubular ring 32 which, as shown in FIGS. 2 and 3, is closely fitting around and engages an outer surface of the plug assembly 10 provided by the cylindrical body 24, and an annular actuating member 34 which is closely fitting around and engages a rear section of the ring 32 and is mounted on the rear end (the end remote from the pins 14, 15) of the plug assembly 10.

In carrying out the invention, a motion converting connection is provided between the actuating member 34 and the ring 32. The motion converting connection is herein shown as two peripherally spaced similarly shaped tube forming cams 36, 38 with angled end surfaces 36*a*, 38*a*, mounted inside the actuating member 34 and cooperating with two matching angled (complementary angled) profile surfaces 40, 42 on the rear peripheral end or edge of the ring 32. The cams 36, 38 and profile surfaces 40, 42 are so arranged that a manual force applied to rotate the actuating member 34 (see FIG. 4) is converted into an axial force $F_1$ (preferably at a mechanical advantage) pressing the ring 32 axially against the socket 12 and an equal and opposite axial force $F_2$ applied to the actuating member 34 and, through a connection 46, to the plug assembly 10 which moves the plug assembly 10 axially, retracts the pins 14, 15 from the contact clips 16, 17, and withdraws the plug assembly 10 from the socket 12.

Instead of a user pulling a plug to remove it from the socket, the user rotates or "twists" the actuating member of the removing mechanism of this invention which causes an axial force $F_1$ to be applied against the socket 12 in a direction tending to hold it against the wall, and a removing force $F_2$ generated within the motion converting connection which moves the plug axially in a direction away from the wall to extract the pins 14, 15 from the socket 12 contact clips and withdraw the plug from the socket.

The plug support 22 and concentric body 24 have a shape such that this assembly can be inserted into any standard socket to inter-engage the power supply pins 14, 15 and ground pin 19 and contact clips 16, 17 and clip 20 enabling the transmission of electrical power from the supply mains through the cable 18. While in FIGS. 1–4 the plug assembly 10 has a laterally extending cable 18, other types of plugs, such as plugs with axial cables are also commonly available, and this invention is especially applicable to all such various standard plugs as will be further explained in connection with an alternative embodiment shown in FIGS. 5–7.

At the periphery of the body 24, which is fixed to the support 22 by a screw 26, there are found two guide rails 50 (see FIG. 9) diametrically opposed on the support 22. An opening 54 provides a lateral exit for passage of the electrical cable 18 connected to the pins 14, 15 and to the "ground" or "earth" pin 19 while a retainer extending axially on the rear face of the body 12, in this embodiment, provides the connection 46 which holds the support 22 and the actuating member 34 together and prevents relative axial movement between them, while allowing relative rotational movement of the actuating member 34 with respect to the plug assembly 10. In this case the retainer comprises at least two elements 56*a* and 56*b* which project from the rear face of the body 24 or the support 22 and pass through an axial opening in the actuating member 34, being made preferably of a flexible plastic material and normally urged apart so that projections 56*c* on the tips of the elements 56*a* and 56*b* act as a retainer and catch and hold the actuating member 34. Preferably the body 24 is a molded plastic part as are the actuating member 34 and ring 32.

In accordance with the invention, the ring 32 is slidable, axially constrained by the guide rails 50 on the body 24, a slot 60 is provided in each of the opposed guide rails 50, and a spring 62 is located in each of the slots 60 in order to return, after actuation of the removing mechanism, the ring 32 and the actuating member 34 to their initial position.

The ring 32 is guided by the guide rails 50 on the body 24 and has guide grooves 64 which receive the guide rails 50. As the actuating member 34 is rotated and caused to move axially away from the socket 12, the springs 62 are compressed so as to return the actuating member 34 when it is released.

The movable actuating member 34, fastened to the body 24, comprises a transverse control grip portion 68 intended to be gripped between the fingers of the user, and a cover portion 70 which forms a skirt concentric with and closely fitting around the rear section of the ring 32. A cut-out 71 in the cover portion 70 enables the passage of the electrical cable 18 when the latter exits laterally while the cover provides a skirt enclosing the powered elements of the plug. The two cams 36, 38 are located in diametrically opposite positions on the inside surface of the cover portion 70 and cooperate with the two diametrically opposite profile surfaces 40, 42 of the ring 32. To limit the relative rotational movement of the actuating member 34, one or a plurality of pins 72 (see FIGS. 2–4) extend from the rear face of the body 24 to be received in arcuate slots 74 extending approximately through an arc of 90° in the inside flat surface of the actuating member 34.

Figure 4:
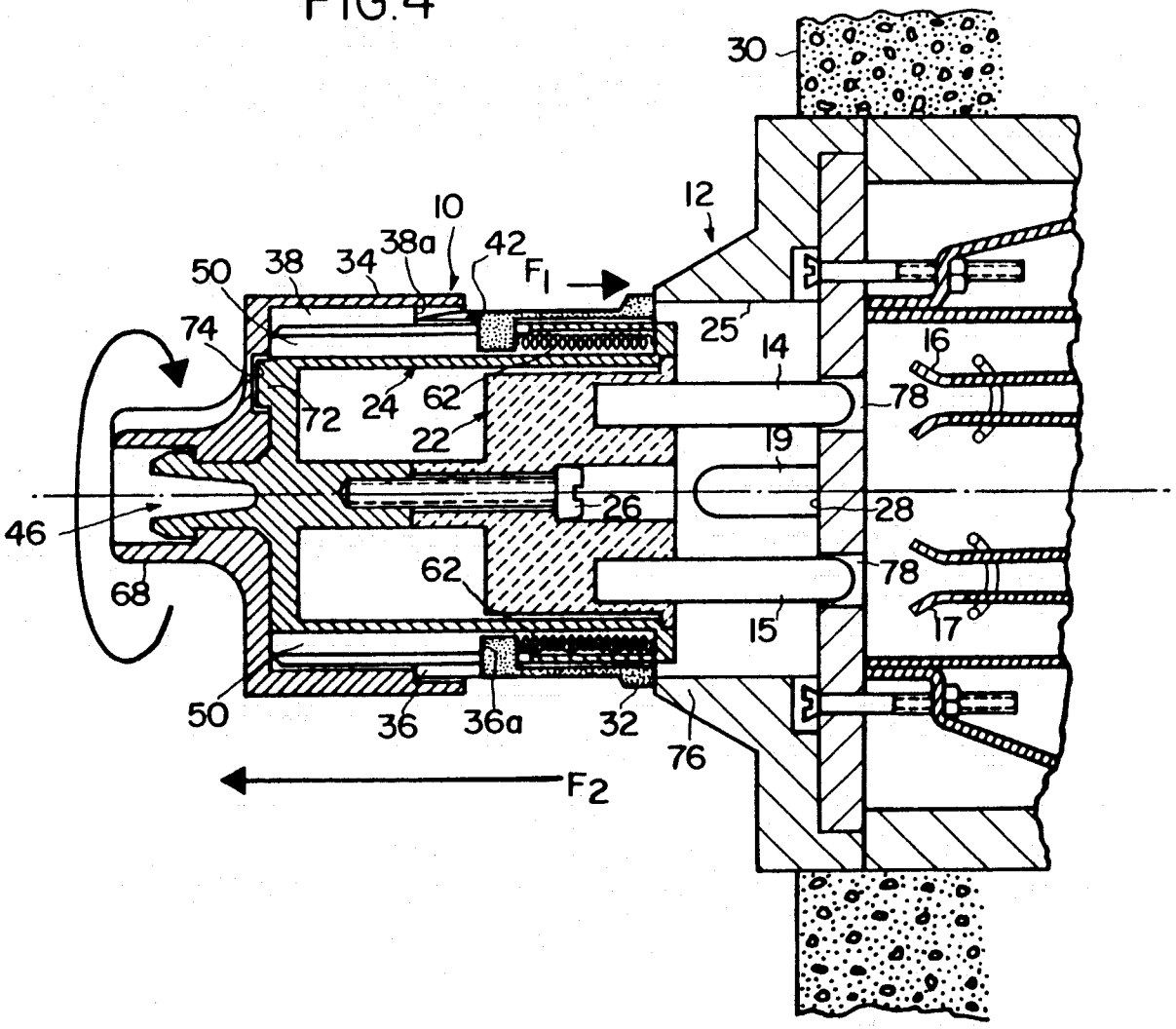
FIG. 4 is a similar view to FIG. 3 with the removing mechanism actuated to withdraw the plug assembly from the socket.
Figure 5:
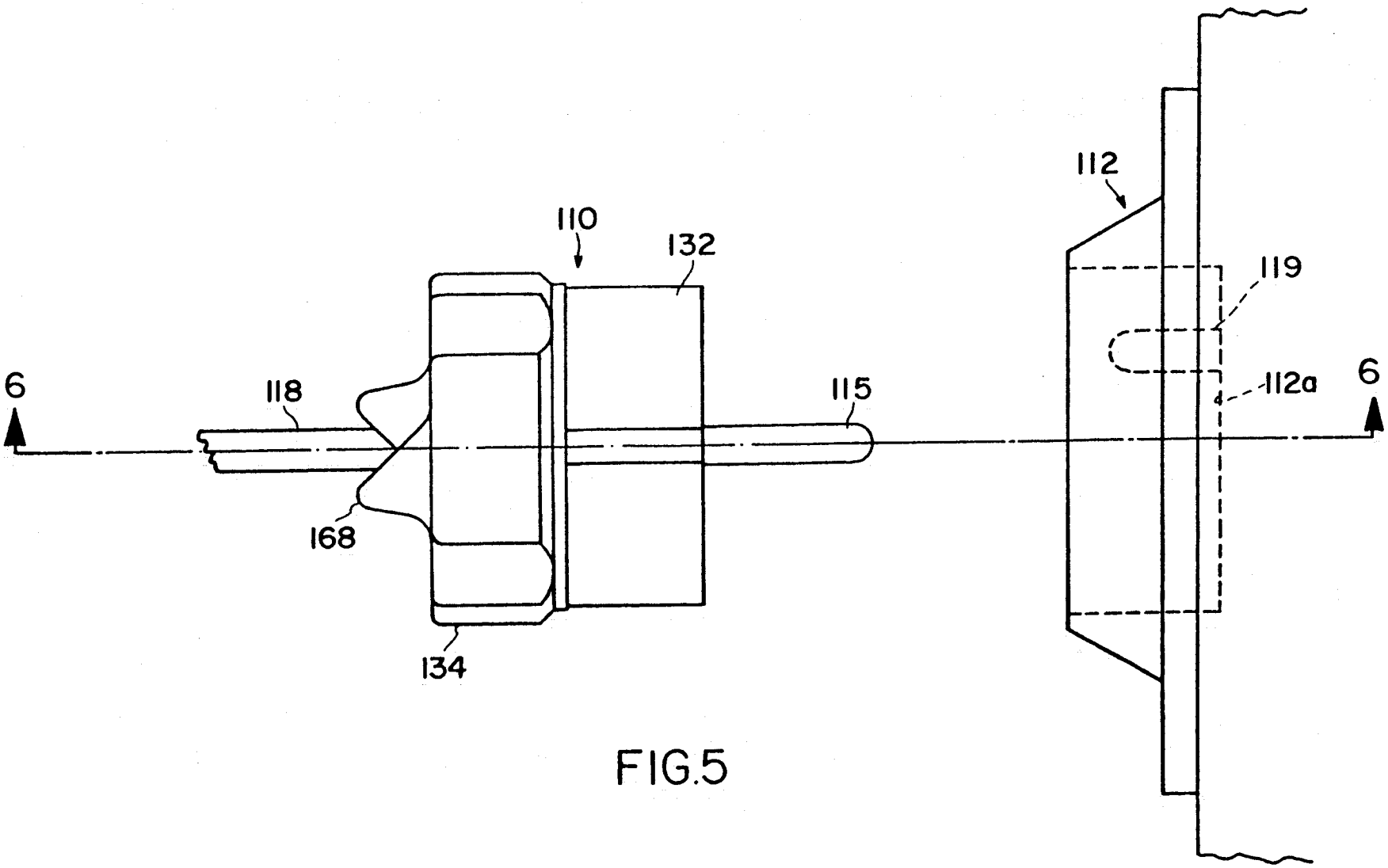
FIG. 5 is a view similar to FIG. 1 of an alternative embodiment of the invention applied to a plug assembly.

Referring to FIGS. 3 and 4, when a plug assembly 10 is inserted in a standard electrical socket 12, the pins 14, 15 are confined in the contact lugs 16, 17 while the front surface of the ring 32 in the present embodiment is spaced with a small clearance from the raised rim 76 of the socket 12. The raised rim 76 has a standardized shape and inside profile such that the holes 78 to the contact clips 16, 17 in the bottom surface of the socket recess are protected from accidental contact and the inside profile of the rim 76 is such that the socket 12 accepts only plugs meeting applicable standards.

Referring to FIG. 4, when the actuating member 34 is rotated by a user, the ring 32 is first moved axially forward toward the socket 12 taking up any clearance that exists between the forward edge of the ring 32 and the socket 12. In the present case the ring 32 is moved forwardly to engage the rim 76 on the socket 12, although in other embodiments of the invention the ring may engage other portions of the socket 12 such as the bottom surface of the socket 12 as in the alternative embodiment of FIGS. 5–7. Continued manual force applied to the grip portion 68 of the actuating member 34 to rotate the actuating member, after the ring 32 has moved into bearing engagement with the rim 76 of the socket 12, causes the actuating member 34 itself both to rotate and to move axially in a direction away from the socket 12. Such additional force applied to rotate the actuating member 34 is converted by the mechanism into an axial force $F_1$ pressing the ring 32 against the rim 76 of the socket 12 and an equal and opposite axial force $F_2$ moving the actuating member 34, together with the pin support 22 to which it is fastened, in a direction away from the socket. Due to this axial movement, the pins 14, 15 are extracted from the contact clips 16, 17 and the plug assembly 10 is moved axially through the tubular ring 32 and withdrawn from the socket 12.

The cutout 71 in the cover portion 70 is dimensioned such that during the rotation of the actuating member 34 the cover portion 70 does not interfere with the electrical cable 18. A longitudinal cut out or slot 71*a* (see FIG. 9) in the ring 32 permits passage of the cable 18 and axial movement of the ring 32. Furthermore, the length of the ring 32, the angle of the cam surfaces 36*a*, 38*a* on the two cams 36, 38 of the actuating member 34, the angle of the profile surfaces 40, 42 which cooperate with the two cams 36, 38 and which are provided on the ring 32, are all arranged such that the pin support 22 and body 24 are moved axially through a stroke sufficient to retract the pins 14, 15 completely from the contact clips 16, 17 so that they are no longer gripped thereby and the plug may be withdrawn easily from the socket.

Figure 8:
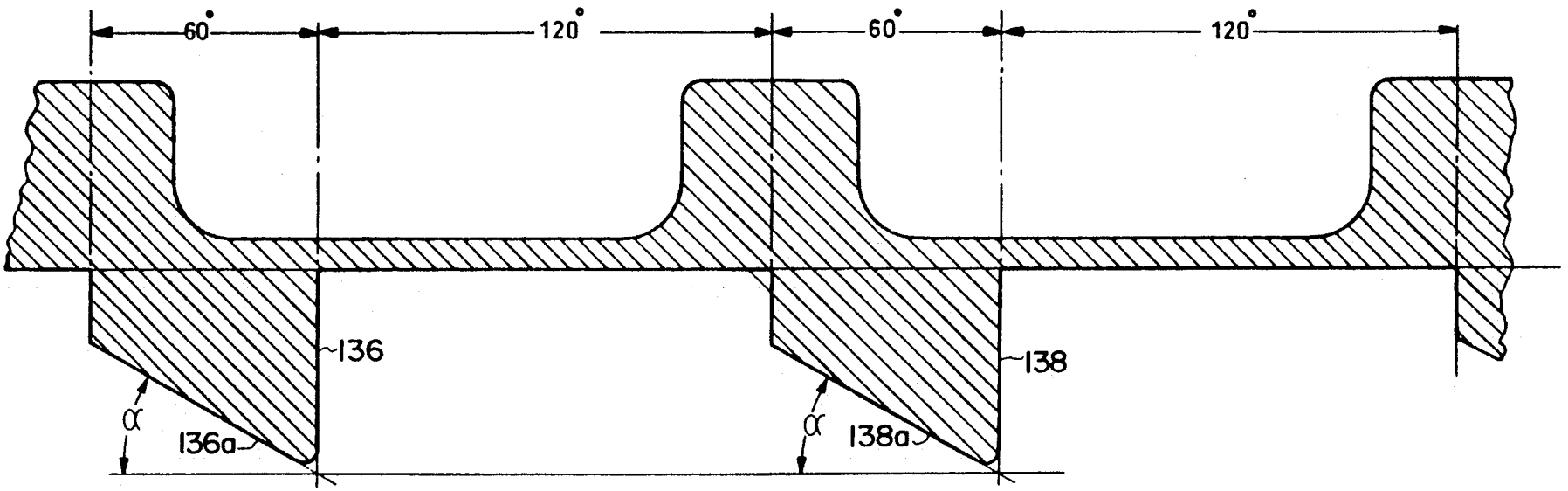
FIG. 8 is a view illustrating the profile of the cam of a removing mechanism according to the invention.

Furthermore, the angles of the cam surfaces 36*a*, 38*a* cooperating with the profile surfaces 40, 42 preferably are such that the pins 14, 15 may be removed from the contact clips with an easily applied rotational force. For example, if the removing of a standard 10 ampere plug requires on average a force between 4 and 5 kilograms, as has been measured, and it is desired that a plug assembly 10 equipped with a removing mechanism according to the invention may be pulled from the socket 12 by means of an average rotational force applied to the actuating member 34 of 1.5 kilograms, a mechanical advantage of 3:1 is required. To this end it has been found that with a standard size plug and socket with the 10 ampere rating, cam surfaces 36*a*, 38*a* are preferably angled at approximately 30° (as illustrated in FIG. 8) and the profile surfaces are preferably substantially the same angle to provide the required mechanical advantage. The range of motion of the actuating member 34, as noted above, is confined to approximately 90° of rotation of the actuating member 34, and with cam surfaces 36*a*, 38*a* angled at an angle x of approximately 30°, and profile surfaces 40, 42 complementary angled, with rotation of the actuating member 34 through an arc of 90° the pins 14, 15 are moved a sufficient stroke distance to completely withdraw them from the contact clips 16, 17. It should be understood, however, that the cam angles and range of motion may be varied to suit the particular size and arrangement of plug and socket components. With the arrangement illustrated, plugs according to the invention may be placed side by side in double or multi-socket strips and the removing mechanism may be operated without awkwardness or interference.

Figure 6:
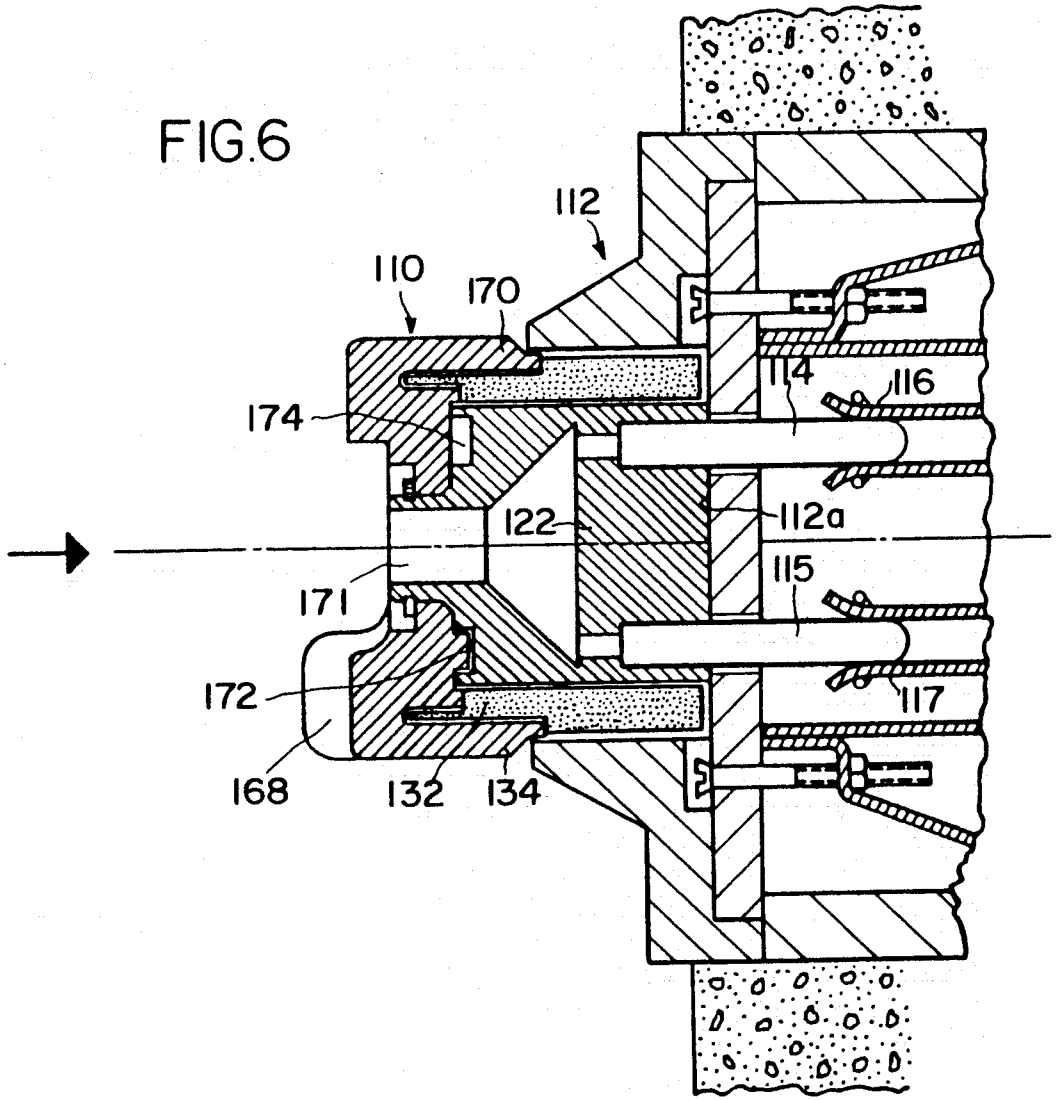
FIGS. 6 and 7 are horizontal cross-sectional views similar to FIGS. 3 and 4, respectively, of the alternative embodiment.

Referring now to FIGS. 5–7 and 10, an alternative embodiment of the invention is shown in which a socket 112 receives a pair of conductor pins 114, 115 inserted in contact clips 116, 117 of the socket 112 when the plug assembly 10 and removing mechanism of the invention is inserted into the socket 112. In this embodiment, the removing mechanism is applied to a plug assembly 110 comprising a pin support 122 and requires but two additional parts including a tubular ring 132, which is concentric and in engagement with the outer surface of the pin support 122 itself, and an annular actuating member 134, which is concentric and in engagement with and closely fits around a rear section of the ring 132. In this embodiment, when the plug assembly 110 is fully inserted in the socket 112, the forward edge of the ring 132 bears on the bottom surface 112*a* of the socket 112, as shown in FIG. 6, and the removing mechanism may then be actuated to remove the plug assembly 110 from the socket 112. As shown on FIG. 10, rounded axial guide rails 150 are formed in the outer surface of the pin support 122 and curved axial guide grooves 164 in the inner periphery of the ring 132 allow relative axial movement and prevent relative rotational movement of the ring 132 and the pin support 122. Return springs 162 are provided within slots 160 in the outer surface of the pin support 122 of the plug assembly 110 which are engaged by projections 132*a* on the inside of the ring 132. Similar to the first embodiment of the invention, two oppositely located cams 136, 138 are provided on the inner front face of the actuating member 134 which cooperate with matching profile surface 140, 142 on the rear peripheral end of the ring 132. As in the first embodiment of the invention, rotational force (a twisting motion) applied to the actuating member via a transverse grip portion 168 is converted by the cams and profile surfaces to axial force moving the actuating member 134 in a direction away from the socket 112 to withdraw the plug assembly 110 from the socket 112.

Figure 7:
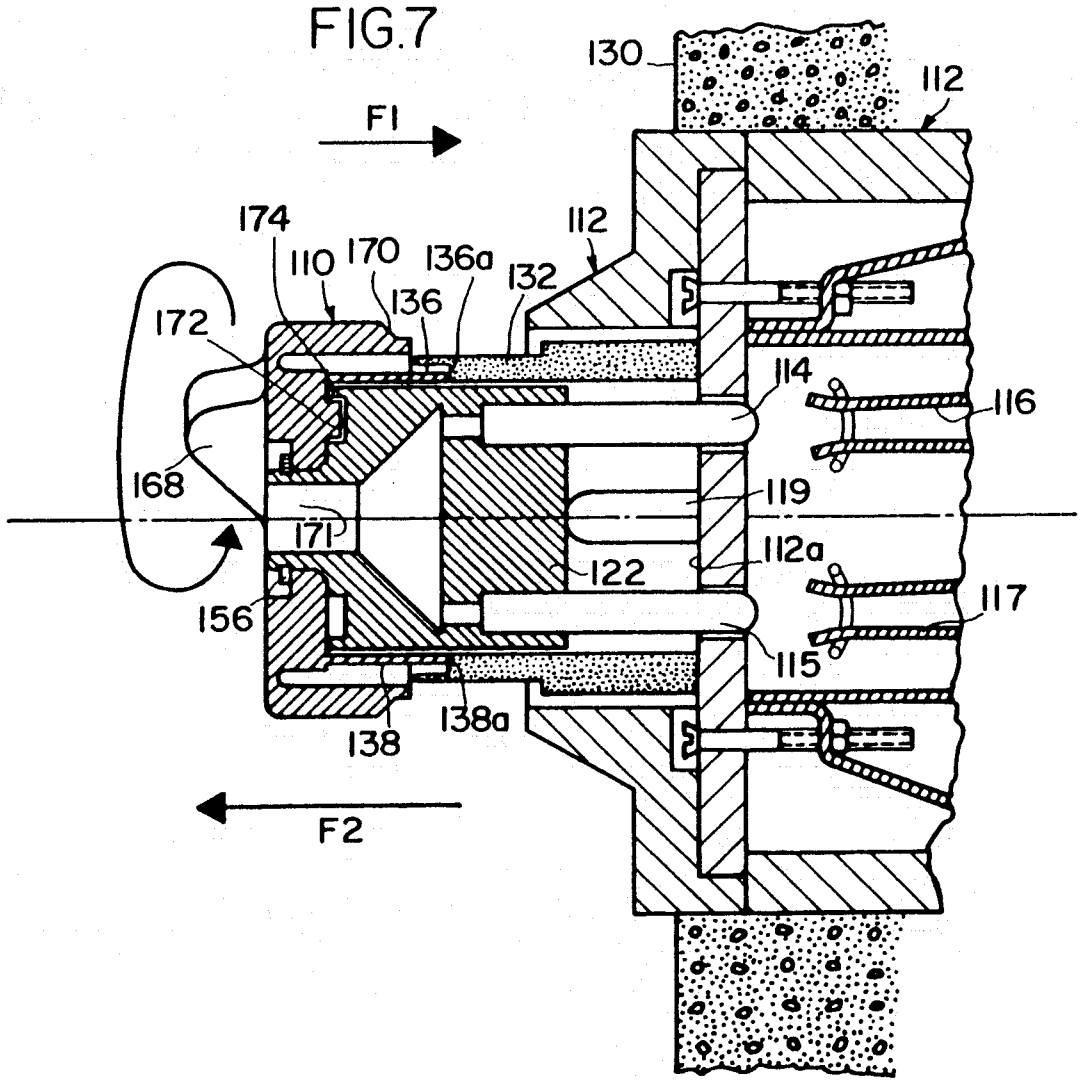

In this case, the forward edge of the ring 132 is flush with the forward face of the pin support 122 in the normal condition of the mechanism (as seen in FIG. 6) and thus is located, when the plug is fully inserted into the socket 112 and before the removing mechanism is actuated, in bearing engagement with the bottom surface 112*a* of the socket 112. When the actuating member 134 is rotated, a force $F_1$ is generated pressing the ring 132 against the bottom surface 112*a* of the socket 112 and an equal and opposite axial force $F_2$ is generated, through the cam and profile arrangement, in a direction to move the plug assembly 110 and pins 114, 115 carried thereby in an axial direction to move the plug assembly 110 through the ring 132 and extract the pins 114, 115 from the contact clips 116, 117 (as seen in FIG. 7). In this manner the pin support 122 comprising the plug assembly 110 is moved axially a sufficient distance to completely withdraw the pins 114, 115 from the contact clips 116, 117 allowing the plug assembly 110 and removing mechanism to be removed easily from the socket.

In this embodiment of the invention the cable 118 exits axially of the plug rather than laterally as in the first embodiment of the invention, and for this purpose an axial opening 171 is provided in the actuating member 134 through which the cable 118 passes and a retainer 156 fastens the actuating member 134 and the pin support 122 while allowing relative rotation. Pins 172 are provided on the inner front face of the actuating member 134 received in arcuate slots 174 in the rear face of the pin support 122, to limit the rotational movement of the actuating member 134, preferably to approximately 90°. As in the first embodiment of the invention, the active angled end surfaces 136*a*, 138*a* of the cams 136, 138 preferably have an angle of approximately 30°, for cooperating with complementary angled profile surfaces 140, 142, to provide a mechanical advantage and force ratio of approximately 3:1 and allow removing of conductor pins 14, 15 easily and readily by a user gripping the actuating member 134 and turning or twisting the same applying manual force.

The return springs 162 return the mechanism to its initial condition after the plug assembly 110 has been safely removed. While a preferred angle of approximately 30° has been illustrated for the angled cam surfaces 136*a*, 138*a* and for the profile surfaces 140, 142, it will be understood that the angle of these surfaces may vary according to the particular application and the desired ratio of force produced to force applied taken into consideration. Thus, it may easily be understood that an angle for the two cams and profile surfaces may vary between 20° and 40° depending on the range of motion needed and the amount of force required.

Furthermore, while in the disclosed embodiments the angled surfaces of the cams and the cooperating profile surfaces are straight, these surfaces may be curvilinear so that the manual force exerted on the gripping member in order to remove a plug assembly may be practically constant. In such a case, the cam profile is inclined over its first half, corresponding to the force required to withdraw the conductors from the grip of the contact clips and requiring significant effort, while more inclined over the second half of the motion producing portion of the cam, which corresponds to the final withdrawal of the plug from the socket, which requires little energy. The cooperating profile and cam surfaces should in such an application have their shapes mutually cooperating.

Figure 11:
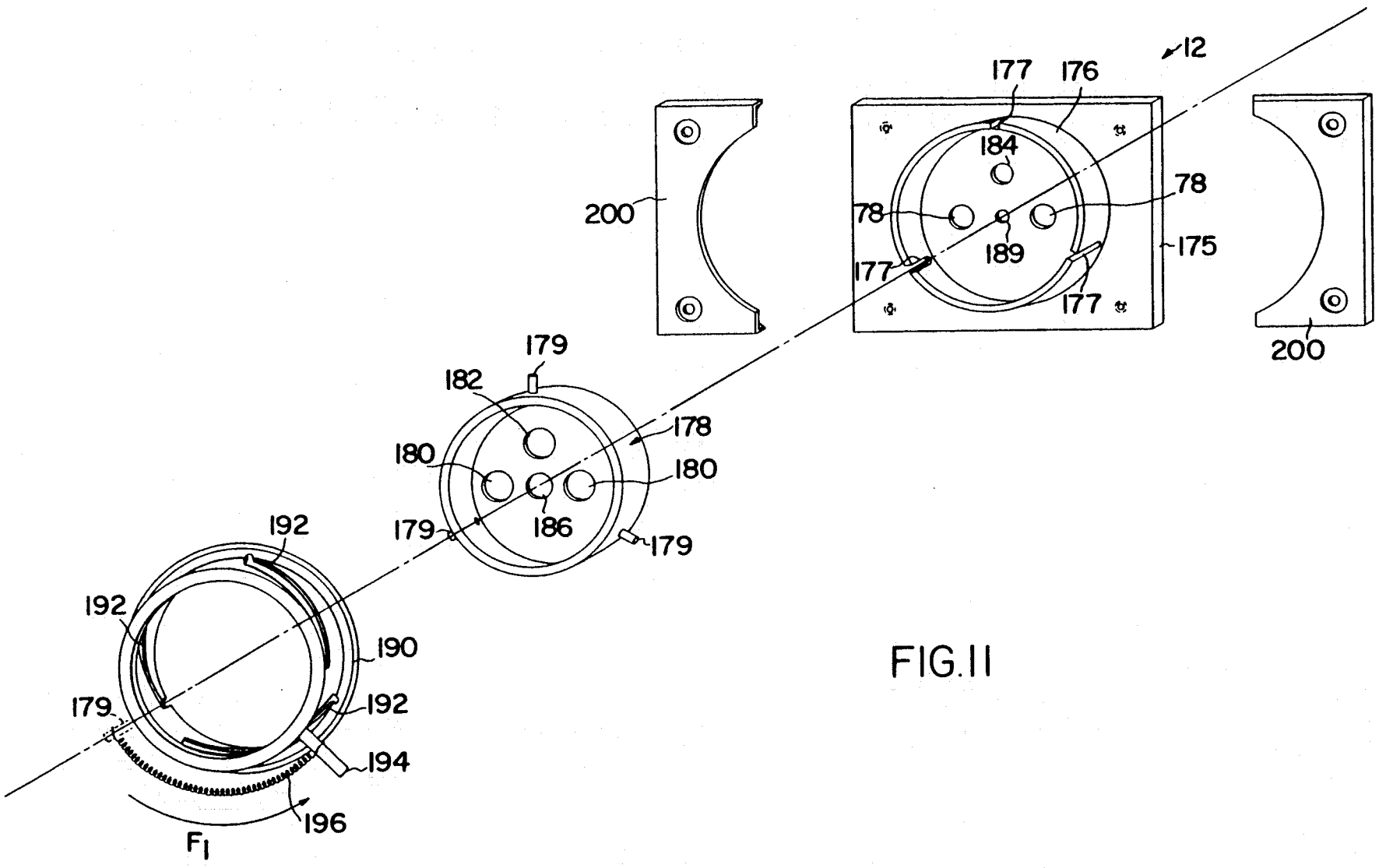
FIG. 11 is an exploded view of a socket assembly, the socket assembly having a removing mechanism according to a third embodiment of the invention.
Figure 14:
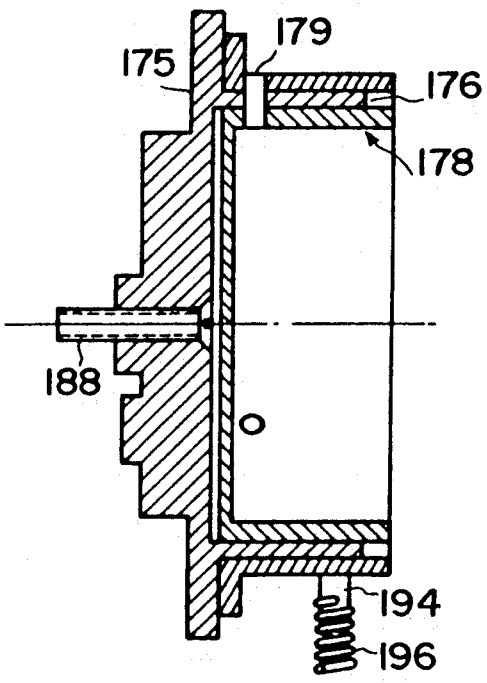
FIGS. 12–13 are end views and FIGS. 14–15 are cross-sectional views taken in the planes of lines 14—14 and 15—15 of FIGS. 12 and 13.
Figure 12:
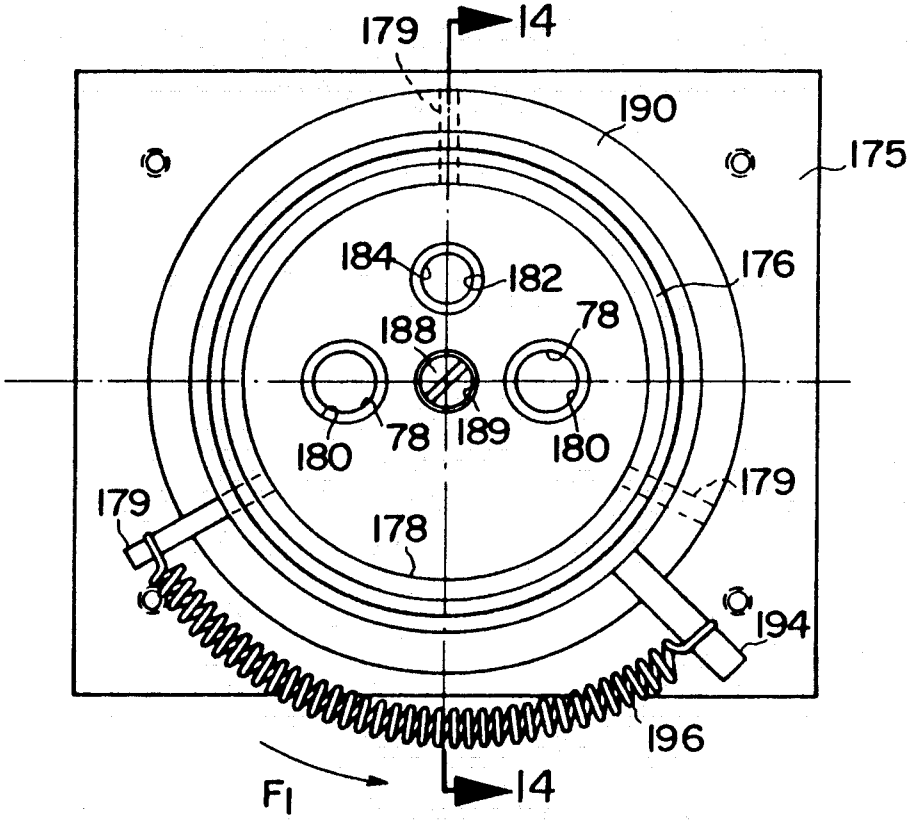
Figure 15:
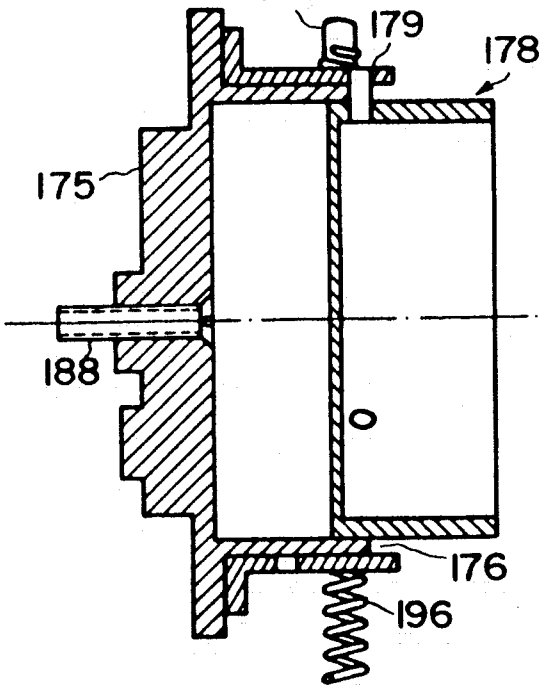
Figure 13:
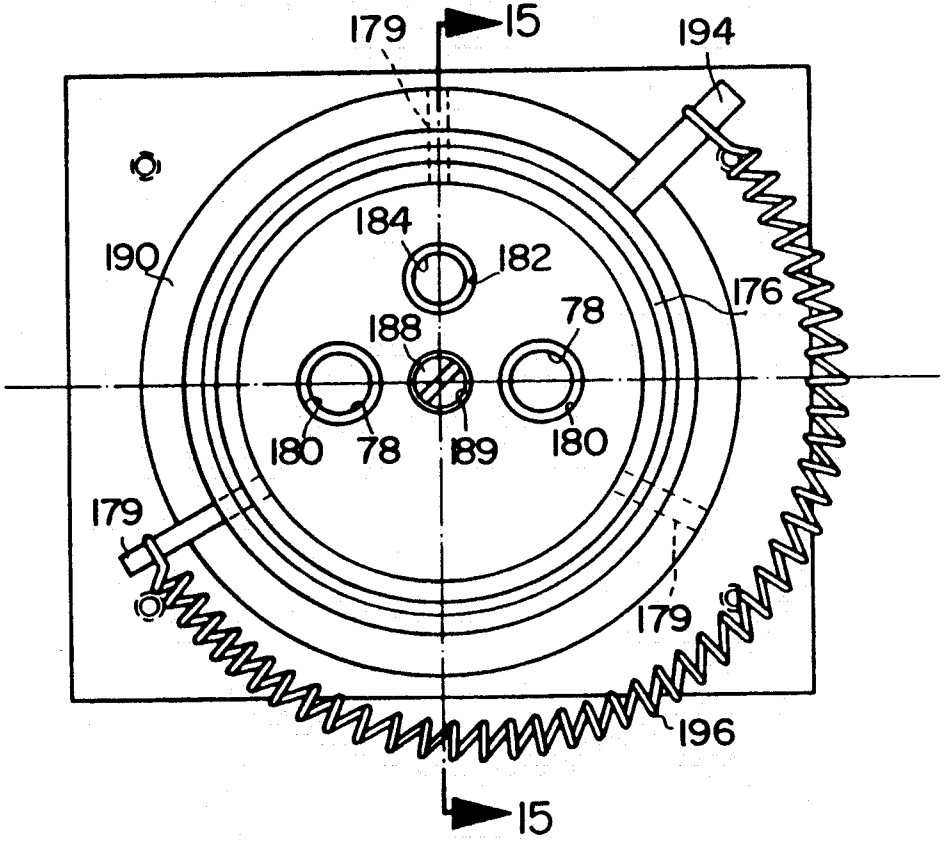

Turning now to FIG. 11, a socket assembly 12 is illustrated in which a removing mechanism constructed according to this invention is mounted to the socket 12 and is operable manually to remove a plug inserted in the socket 12 effortlessly and safely.

The plug removing mechanism of this embodiment (see FIGS. 11–15) is mounted on a standard cover protection plate 175 of a standard socket assembly 12. Such plate 175 includes a rim 176 provided with three axial guide slots 177 which are 120° apart.

The rim 176 receives a cylindrical thrust member 178, the external surface of which bears on the internal surface of the rim 176; three studs 179 that it bears cooperate with the three guide slots 177 so that the thrust member has an axial movement with reference to the rim 176.

The thrust member 178 has several openings, two holes 180 corresponding to holes 78 in the plate 175 allowing the pins 14, 15 of a plug assembly 10 to enter the clips 16, 17, a hole 182 matching the hole 184 of the plate 175 for the "ground" pin and a central hole 186 allowing access to a screw 188 which locks the plate 175 to the socket 12 through the opening 189.

In carrying out the invention, an actuating member 190 having an annular shape is mounted on the external periphery of the rim 176 for rotation around it and has three inclined slots 192 also cooperating with the studs 179. It also bears a control handle 194 and a spring 196, one end of which is attached to the control handle 194 and the other end to one of the studs 179, which resiliently forces said mechanism in rest (backwards) position where any plug can be inserted in the socket 12.

When the user wishes to remove the plug 10, all the user has to do is rotate the handle 194 according to the arrow F1 and movement of the slots 192 powers displacement of the studs 179 and thus the thrust member 178 along the guide slots 177. Therefore, the thrust member 178 by coming into contact with the pin support 22 of a standard plug retracts said plug from the socket 12.

Of course, the thrust member 178 can have any shape (disc, triangle, etc . . . ) as long as it cooperates with the support 22. It is preferable to have it as thin as possible to have a compact mechanism.

Two lateral plates 200 are shown to keep the assembly together but catches can be provided in the plate 175 instead of separate plates.

In addition, it should be noted that for a flush socket, the assembly described here-above is provided on or within the socket.

I claim:

1. An electrical-plug-removing mechanism comprising:

a plug assembly having a front end carrying axially extending pins which are inserted in and retracted from contact clips of a socket upon axial movement of said plug assembly, said plug assembly having an exposed outer lateral surface which extends from the front end to a rear end and a lateral or axial exit for a cable connected to the pins; and a control mechanism for moving said plug assembly axially to retract the pins when the plug assembly is plugged into a socket with its front end abutting the socket, said control mechanism including concentric relatively movable members including a rotatable annular actuating member mounted for rotation about said plug assembly proximate its rear end and which exerts an axial force that moves the plug assembly, and an axially extending tubular ring member peripheral to and guided by the exposed lateral surface of said plug assembly so that a peripheral front end of said tubular ring member presses against the socket and a peripheral rear end of said tubular ring member lies outward of said rear end of said lateral surface of said plug assembly allowing passage of said plug assembly, and a motion converting connection between the members which converts a manual force applied to rotate said annular actuating member into an axial force applied through the front end of said tubular ring member against the socket and a substantially equal and opposite axial force applied to said plug assembly which moves the plug assembly axially through the peripheral rear end of said tubular ring member in a direction away from the socket and retracts the pins from the contact clips.

2. An electrical-plug-removing mechanism according to claim 1 wherein said plug assembly has an axially extending cable which exits said plug assembly at its rear end and is electrically connected to the pins, and said actuating member has an axial opening to permit the cable to pass without interference.

3. An electrical-plug-removing mechanism according to claim 1 wherein said motion converting connection includes a skirt and a cam on an inner surface of said skirt presenting a forwardly facing angled cam surface and a cooperating rearwardly facing cam surface on the peripheral rear end of said tubular ring member which is engaged by and cooperates with the angled cam surface of said cam.

4. An electrical-plug-removing mechanism according to claim 3 wherein the cam surface has an angle providing a mechanical advantage of substantially 3:1.

5. An electrical-plug-removing mechanism according to claim 3 including a resilient return member in a slot of said guides acting axially between said plug assembly and said tubular ring member to return said annular actuating member via said motion converting connection after rotational movement of said annular actuating member to move said plug assembly axially and retract the pins.

6. An electrical-plug-removing mechanism according to claim 1 wherein said tubular ring member and plug assembly are guided for relative axial movement by slotted guides, and said annular actuating member is connected to transmit axial force to move said plug assembly.

7. An electrical-plug-removing mechanism according to claim 6 wherein said annular actuating member is formed with a transverse grip portion at across the rear end thereof remote from the front end of said plug assembly.

8. An electrical-plug-removing mechanism according to claim 7 wherein said plug assembly has a laterally extending cable which exits said plug assembly laterally through said skirt and is electrically connected to the pins, and said skirt is cut out adjacent the cable to permit rotational movement of said annular actuating member without interference with the cable.

9. An electrical-plug-removing mechanism comprising an axially movable thrust member mounted for axial movement on a socket and an annular actuating member mounted for rotational movement about the socket, and a motion converting connection including angled cam slots on the annular actuating member cooperating with studs connected to the thrust member whereby rotation of the annular actuating member by a manual force causes axial movement of the thrust member which engages and moves a plug assembly plugged into the socket and retracts the pins.

10. An electrical-plug-removing mechanism according to claim 9 wherein the socket includes a rim having axial guide slots and the studs extend, respectively, through the slots and into the annular angled cam slots on the actuating member.

11. An electrical-plug-removing mechanism according to claim 9 wherein the socket includes a rim having axial guide slots and said thrust member is guided axially by said slots.

12. An electrical-plug-removing mechanism according to claim 11 wherein one member is a thrust member mounted for axial movement on the socket and one member is an annular actuating member mounted for rotational movement on the socket, and the motion converting connection includes angled cam slots on the actuating member cooperating with studs on the thrust member whereby rotation of the actuating member causes axial movement of the thrust member which moves the plug assembly and retracts the pins.

13. A removing mechanism for a plug assembly which is insertable in and retractable from a socket upon axial movement of the plug assembly, said plug assembly having an outer exposed surface, pins extending forwardly from a front end thereof, and a lateral exit for a cable connected to the pins, said mechanism comprising:

relatively movable members including an inner tubular ring member and an outer annular actuating member mounted concentrically about the plug assembly, the tubular ring member being guided for axial movement on the outer exposed surface of the plug assembly and extending from a front end which is engageable with the socket to a rear end, the outer annular actuating member being rotatably mounted around and engaging a portion proximate the rear end of the tubular ring member, a retainer which holds the actuating member to the plug assembly and allows relative rotational movement of the members;

a motion converting connection between the members including forwardly facing circumferentially extending angled cam surfaces inside the annular actuating member and cooperating rearwardly facing angled cam surfaces extending circumferentially around the rear end of the tubular ring member which engage the cam surfaces on the annular actuating member and convert a manual force applied to rotate the annular actuating member relative to the ring member into an axial force pressing against the socket via the front end of the tubular ring member and a substantially equal and opposite axial force applied to the plug assembly from the annular actuating member which moves the plug assembly axially through the tubular ring member in a direction away from the socket and retracts the plug assembly; and means providing for lateral exit of the cable from the plug assembly without interference with the rotational movement of the annular actuating member and the axial movement of the tubular ring member including cut outs in the members adjacent the cam surfaces.

14. A plug assembly having a front end carrying axially extending pins which are insertable in and retractable from contact clips of a socket upon axial movement of said plug assembly, said plug assembly having an exposed outer lateral surface which extends from the front end to a rear end and a lateral or axial exit for a cable connected to the pins;

a control mechanism for moving said plug assembly axially to retract the pins from the contact clips when said plug assembly is plugged into a socket with its front end abutting the socket, said control mechanism including an axially extending rotatable annular actuating member mounted for rotation about said plug assembly proximate its rear end so as to be rotatable by a manual force without contacting the socket, an axially extending tubular ring peripheral to and guided by the exposed outer lateral surface of said plug assembly so that said tubular ring and said plug assembly have a relative axial movement, said tubular ring having a peripheral rear end located proximate the rear end of said plug assembly allowing passage of said plug assembly, a motion converting connection which converts a manual force applied to rotate said annular actuating member into an axial force applied to said tubular ring, said tubular ring applying through its front end the axial force against said socket, and thus generating a substantially equal and opposite axial force applied to said plug assembly via its rear end to move said plug assembly axially through the tubular ring away from the socket and thus retract the pins from the contact clips.

15. An electrical-plug-removing mechanism according to claim 14 wherein said annular actuating member is fastened to the plug assembly and is mounted for relative rotational movement on an outer surface portion of said tubular ring.

16. An electrical-plug-removing mechanism according to claim 14 wherein said said annular actuating member and said tubular ring are concentrically arranged closely fitting in bearing contact around the plug assembly.

17. An electrical-plug-removing mechanism according to claim 14 including a resilient return member acting axially between said plug assembly and said tubular ring to return said tubular ring which returns said annular actuating member via said motion converting connection after rotational movement of said annular actuating member to move the plug axially to retract the plug.

18. An electrical-plug-removing mechanism according to claim 14 wherein said motion converting connection includes a cam on said annular actuating member presenting an angled cam surface and a cooperating surface providing the peripheral rear end of said tubular ring which is engaged by and cooperates with the angled cam surface of said cam.

19. An electrical-plug-removing mechanism according to claim 18 wherein the cam has a curvilinear surface curvature of which is varied to substantially correspond to an axial force necessary to remove the plug assembly from the socket.

20. An-electrical-plug-removing mechanism according to claim 18 wherein the cam surface has an angle providing a mechanical advantage.

21. An-electrical-plug-removing mechanism according to claim 20 wherein the mechanical advantage is substantially 3:1.

22. An electrical-plug-removing mechanism according to claim 14 wherein said annular actuating member includes a skirt around the tubular ring and is formed with a transverse grip portion across its rear end remote from the front end of said plug assembly.

23. An electrical-plug-removing mechanism according to claim 22 wherein the plug assembly has a cable electrically connected to the pins which exits the plug assembly laterally through the skirt, and the skirt is cut out adjacent the cable and the tubular ring has an axial cut out to permit rotational movement of the annular actuating member and axial movement of the tubular ring without interference with the cable.

24. An electrical-plug-removing mechanism according to claim 22 wherein the plug assembly has a cable electrically connected to the pins which exits the plug assembly axially from its rear end, and the annular actuating member has an axial opening to permit the cable to pass without interference.

25. In combination:

an electrical socket having a recess of prescribed inner profile and depth, and contact clips behind a bottom surface of the recess;

a plug assembly having a front end carrying axially extending pins which are insertable in and retractable from contact clips of said socket upon axial movement of said plug assembly, said plug assembly having an exposed outer lateral surface which extends axially from the front end to a rear end and has a profile, viewed from the front end corresponding to the prescribed inner profile of the socket recess, and a lateral or axial exit for a cable connected to the pins; and a removing mechanism for moving said plug assembly axially to retract the pins from the contact clips when said plug assembly is plugged into said socket with the front end abutting the socket, said removing mechanism including an axially movable tubular ring peripheral to and guided by the exposed outer lateral surface of said plug assembly so that a peripheral front end of said tubular ring is engageable against said socket, a rotatable annular actuating member mounted for rotation about and connected to said plug assembly proximate its rear end so as to be rotatable by a manual force without contacting the socket, a motion converting cam connection between said rotatable annular actuating member and said axially movable tubular ring which converts an annular force applied to rotate said rotatable actuating member into an axial force, said tubular ring applying through its front end the axial force against said socket, and thus generating a substantially equal and opposite force applied to said plug assembly via the connection to its rear end which moves said plug assembly axially through the tubular ring away from the socket and thus retracts the pins from the contact clips.

* * * * *